US005567580A

United States Patent [19]

Fenton et al.

[11] Patent Number: 5,567,580

[45] Date of Patent: Oct. 22, 1996

[54] RADIOGRAPHIC ELEMENTS FOR MEDICAL DIAGNOSTIC IMAGING EXHIBITING IMPROVED SPEED-GRANULARITY CHARACTERISTICS

[75] Inventors: David E. Fenton; Lucius S. Fox, both of Fairport; Donald L. Black, Webster, all of N.Y.

[73] Assignee: Eastman Kodak Company, Rochester, N.Y.

[21] Appl. No.: 536,898

[22] Filed: Sep. 29, 1995

Related U.S. Application Data

[63] Continuation-in-part of Ser. No. 329,591, Oct. 26, 1994, Pat. No. 5,476,760.

[51] Int. Cl.[6] ..... G03C 1/035

[52] U.S. Cl. ..... 430/567; 430/569; 430/966

[58] Field of Search ..... 430/567, 569, 430/966

[56] References Cited

U.S. PATENT DOCUMENTS

| | | | |
|---|---|---|---|
| 4,210,450 | 7/1980 | Corben | 430/567 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,883,748 | 11/1989 | Hayakawa | 430/567 |
| 5,061,609 | 10/1991 | Piggin et al. | 430/569 |
| 5,061,616 | 10/1991 | Piggin et al. | 430/569 |
| 5,096,806 | 3/1992 | Nakamura et al. | 430/567 |
| 5,132,203 | 7/1992 | Bell et al. | 430/567 |
| 5,206,133 | 4/1993 | Bando | 430/567 |
| 5,314,798 | 5/1994 | Brust et al. | 430/567 |
| 5,358,840 | 10/1994 | Chaffee et al. | 430/567 |
| 5,476,760 | 12/1995 | Fenton et al. | 430/567 |

*Primary Examiner*—Janet C. Baxter
*Assistant Examiner*—Mark F. Huff
*Attorney, Agent, or Firm*—Carl O. Thomas

[57] ABSTRACT

A radiographic element for medical diagnostic imaging is disclosed comprised of a transparent support and first and second silver halide emulsion layer units coated on opposite sides of the film support, each emulsion layer unit being comprised of a silver iodohalide tabular grain emulsion containing less than 5 mole percent iodide, based on silver. An improvement in speed in relation to granularity is obtained by the presence of tabular grains having {111} major faces, containing a maximum surface iodide concentration along their edges, and a lower iodide concentration within their corners than elsewhere along their edges.

7 Claims, 1 Drawing Sheet

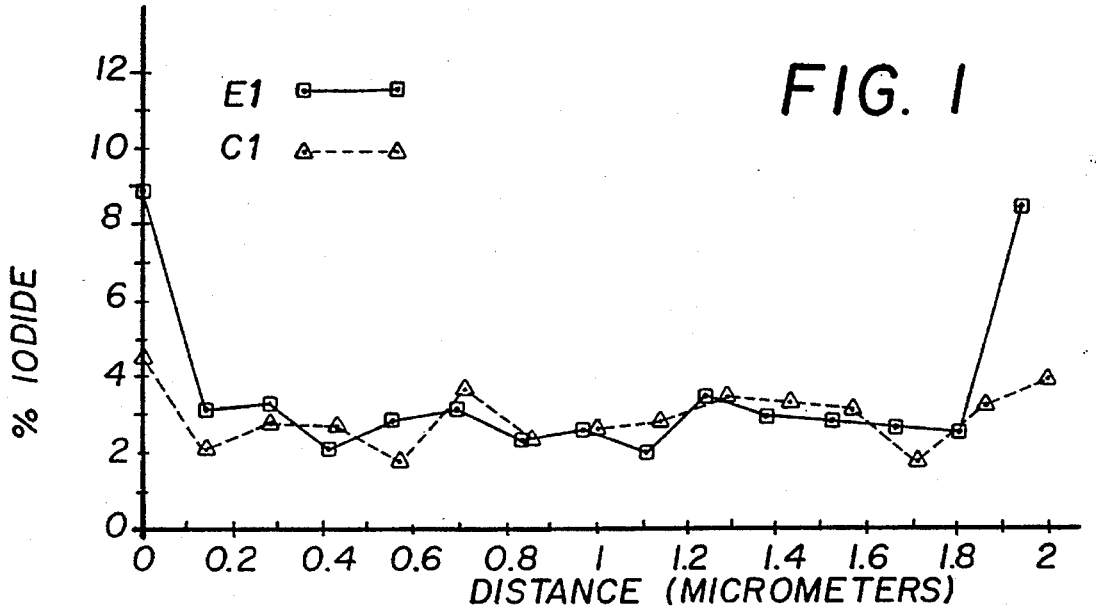
FIG. 1
FIG. 2
(CONTROL)
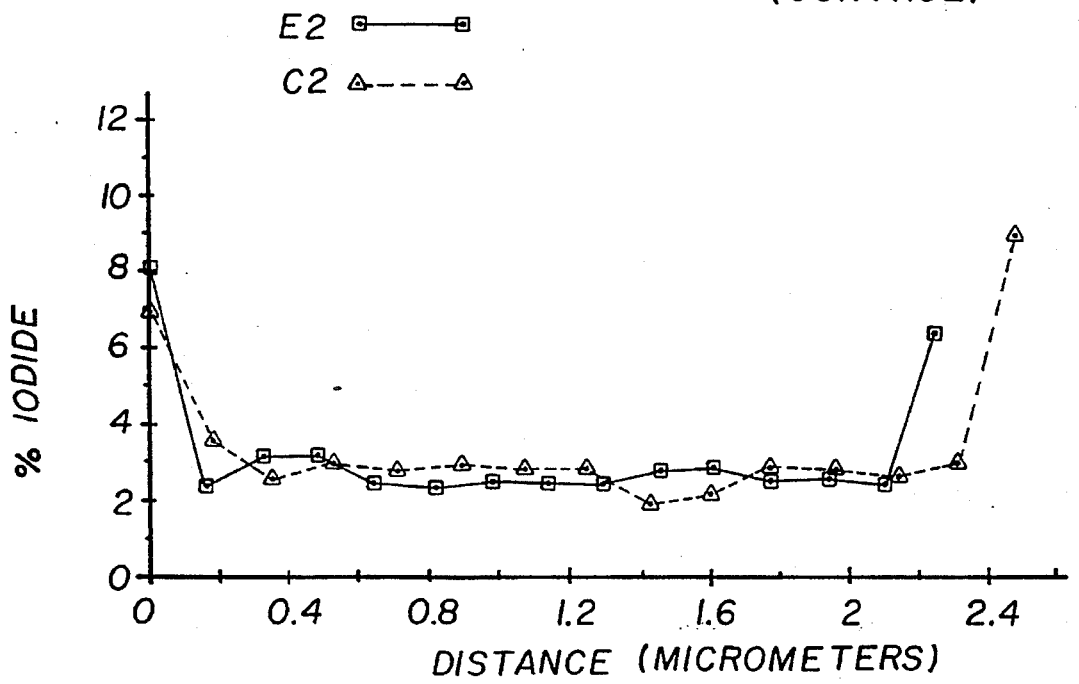

RADIOGRAPHIC ELEMENTS FOR MEDICAL DIAGNOSTIC IMAGING EXHIBITING IMPROVED SPEED-GRANULARITY CHARACTERISTICS

This is a continuation-in-part of U.S. Ser. No. 08/329,591, filed Oct. 26, 1994, now U.S. Pat. No. 5,476,760.

FIELD OF THE INVENTION

The invention is directed to radiographic elements suitable for medical diagnostic imaging containing silver iodohalide emulsion layer units.

1. Definitions of Terms

The term "tabular grain emulsion" is employed to indicate a silver halide emulsion in which tabular grains account for at least 50 percent of total grain projected area.

The term "tabular grain" is employed to indicate a silver halide grain that exhibits an aspect ratio of at least 2, where the aspect ratio of a grain is the ratio of its equivalent circular diameter to its thickness.

The term "{111} tabular grain" is employed to indicate tabular grains having major faces lying in {111} crystal planes.

In referring grains or emulsions containing two or more halides, the halides are named in order of ascending concentrations.

The term "iodohalide" in referring to tabular grains and emulsions is employed to indicate a composition containing iodide in a face centered cubic rock salt crystal lattice structure of the type formed by silver bromide and/or chloride.

2. Background

Kofron et al U.S. Pat. No. 4,439,520, Wilgus et al U.S. Pat. No. 4,434,226 and Solberg et al U.S. Pat. No. 4,433,048 disclose silver iodohalide {111} tabular grain emulsions that exhibit improved speed-granularity relationships.

Abbott et al U.S. Pat. Nos. 4,425,425 and 4,425,426 disclose spectrally sensitized {111} tabular grain emulsions coated on opposite sides of a transparent film. The emulsions can be silver iodohalide tabular grain emulsions, and an intended application is for medical diagnostic imaging.

Chaffee et al U.S. Pat. No. 5,358,840 discloses a {111} tabular grain emulsion in which iodide is present in central portions of the tabular grain major faces extending to a depth of 0.02 μm in a concentration in excess of 6 mole percent with overall iodide concentration of the tabular grains being in the range of from 2 to <10 mole percent, based on silver.

SUMMARY OF THE INVENTION

In one aspect this invention is directed to a radiographic element for medical diagnostic imaging comprised of a transparent support and first and second silver halide emulsion layer units coated on opposite sides of the film support, each emulsion layer unit being comprised of a silver iodohalide tabular grain emulsion containing less than 5 mole percent iodide, based on silver, wherein an improvement in speed in relation to granularity is obtained by the presence of tabular grains having {111} major faces, containing a maximum surface iodide concentration along their edges, and a lower iodide concentration within their corners than elsewhere along their edges.

BRIEF DESCRIPTION OF THE DRAWINGS

FIGS. 1 and 2 each show the iodide concentration profiles of a tabular grain where the profile is taken from edge-to-edge (see line E—E below) or from corner-to-corner (see line C—C below), where FIG. 1 demonstrates profiles from a tabular grain emulsion satisfying the requirements of the invention and FIG. 2 demonstrates iodide profiles from a conventional tabular grain.

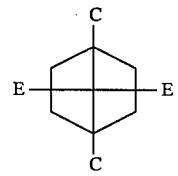

DESCRIPTION OF PREFERRED EMBODIMENTS

The radiographic elements of the invention are suitable for medical diagnostic imaging. To minimize patient exposure to X-radiation the elements are dual-coated (that is, constructed with emulsion layer units on the front and back side of the support) and are intended to be used with front and back intensifying screens, which absorb X-radiation and emit longer wavelength, non-ionizing electromagnetic radiation, which the radiographic elements can more efficiently capture. Dual-coating and intensifying screens together reduce patient X-radiation exposures to less than 5 percent of the levels that would otherwise be required for imaging.

In the simplest form contemplated the radiographic elements of the invention exhibit the following structure:

| |
|---|
| Emulsion Layer Unit (ELU) |
| Transparent Support (TS) |
| Emulsion Layer Unit (ELU) |

The transparent support TS can take the form of any conventional transparent radiographic element support.

The emulsion layer units (ELU) are in their simplest and preferred form identical and contain a single silver iodohalide {111} tabular grain emulsion in a single layer.

It has been discovered quite unexpectedly that enhanced speed-granularity relationships can be realized by employing silver iodohalide tabular grain emulsions containing novel tabular grain structures. The term "speed-granularity relationship" is employed as described by Kofron et al U.S. Pat. No. 4,439,520, here incorporated by reference. An emulsion that exhibits an increased speed without an increase in granularity exhibits an improved speed-granularity relationship. An emulsion that exhibits the same speed at a reduced granularity exhibits an improved speed-granularity relationship. It is possible to compare the speed-granularity relationships of emulsions of differing speed and granularity by assigning an "adjusted" speed, based on the art accepted observation that each speed increase of 30 relative speed units (0.30 log E, where E is exposure in lux-seconds) results in a granularity increase of 7 grain units. For example, to compare the speed-granularity relationship of a first emulsion exhibiting a relative speed of 100 and a granularity of 23 grain units to the speed-granularity relationship of a second emulsion exhibiting a relative speed of 110 and a granularity of 30 grain units, the granularity advantage of 7 grain units of the first emulsion is converted into a speed increase of 30 relative speed units to provide an adjusted speed of 130. Thus, the first emulsion can be seen to have a more favorable speed-granularity relationship than the second emulsion.

It has been discovered that the speed-granularity relationships of silver iodohalide {111} tabular grains can be improved by managing the placement of surface (particularly, edge and corner) iodide in {111} tabular grains in a manner that has not been heretofore recognized nor attempted. Specifically, the {111} tabular grains contain a maximum surface iodide concentration along their edges and a lower surface iodide concentration within their corners than elsewhere along their edges. The term "surface iodide concentration" refers to the iodide concentration, based on silver, that lies within 0.02 μm of the tabular grain surface.

The starting point for the preparation of an emulsion satisfying the requirements of the invention can be any conventional {111} tabular grain emulsion in which the tabular grains have a surface iodide concentration of less than 2 mole percent.

For tabular grains to have {111} major faces it is necessary that the grains contain a face centered cubic rock salt crystal lattice structure. Both silver bromide and silver chloride are capable of forming this type of crystal lattice structure, but silver iodide cannot. Thus, the starting tabular grains can be selected from among silver bromide, silver chloride, silver chlorobromide and silver bromochloride. Although silver iodide does not form a face centered cubic crystal lattice structure (except under conditions not relevant to photography), minor amounts of iodide can be tolerated in the face centered cubic crystal lattice structures formed by silver chloride and/or bromide. Thus, the starting tabular grains can additionally include silver iodobromide, silver iodochloride, silver iodochlorobromide, silver iodobromochloride, silver chloroiodobromide and silver bromoiodochloride compositions, provided surface iodide concentrations are limited to less than 2 mole percent and overall iodide levels are limited to satisfy overall iodide levels in the completed grains discussed below.

The {111} tabular grain emulsions suitable for use as starting emulsions can be selected from among conventional {111} tabular grain emulsions, such as those disclosed by Wey U.S. Pat. No. 4,399,215, Maskasky U.S. Pat. Nos. 4,400,463, 4,684,607, 4,713,320, 4,713,323, 5,061,617, 5,178,997, 5,178,998, 5,183,732, 5,185,239, 5,217,858 and 5,221,602, Wey et al U.S. Pat. No. 4,414,306, Daubendiek et al U.S. Pat. Nos. 4,414,310, 4,672,027, 4,693,964 and 4,914,014, Abbott et al U.S. Pat. No. 4,425,426, Wilgus et al U.S. Pat. No. 4,434,226, Kofron et al U.S. Pat. No. 4,439,520, Sugimoto et al U.S. Pat. No. 4,665,012, Yagi et al U.S. Pat. No. 4,686,176, Hayashi U.S. Pat. No. 4,748,106, Goda U.S. Pat. No. 4,775,617, Takada et al U.S. Pat. No. 4,783,398, Saitou et al U.S. Pat. Nos. 4,797,354 and 4,977,074, Tufano U.S. Pat. No. 4,801,523, Tufano et al U.S. Pat. No. 4,804,621, Ikeda et al U.S. Pat. No. 4,806,461 and EPO 0 485 946, Makino et al U.S. Pat. No. 4,853,322, Nishikawa et al U.S. Pat. No. 4,952,491, Houle et al U.S. Pat. No. 5,035,992, Takehara et al U.S. Pat. No. 5,068,173, Nakamura et al U.S. Pat. No. 5,096,806, Tsaur et al U.S. Pat. Nos. 5,147,771, '772, '773, 5,171,659, 5,210,013 and 5,252,453, Jones et al U.S. Pat. No. 5,176,991, Maskasky et al U.S. Pat. No. 5,176,992, Black et al U.S. Pat. No. 5,219,720, Maruyama et al U.S. Pat. No. 5,238,796, Antoniades et al U.S. Pat. No. 5,250,403, Zola et al EPO 0 362 699, Urabe EPO 0 460 656, Verbeek EPO 0 481 133, EPO 0 503 700 and EPO 0 532 801, Jagannathan et al EPO 0 515 894 and Sekiya et al EPO 0 547 912.

In their simplest form the starting tabular grains contain less than 2 mole percent iodide throughout. However, the presence of higher levels of iodide within the interior of the tabular grains is compatible with the practice of the invention, provided a lower iodide shell is present that brings the starting tabular grains into conformity with the surface iodide concentration limits noted above.

The surface iodide modification of the starting {111} tabular grain emulsion to enhance sensitivity can commence under any convenient conventional emulsion precipitation condition. For example, iodide introduction can commence immediately upon completing precipitation of the starting tabular grain emulsion. When the starting tabular grain emulsion has been previously prepared and is later introduced into the reaction vessel, conditions within the reaction vessel are adjusted within conventional tabular grain emulsion preparation parameters to those present at the conclusion of starting {111} tabular grain emulsion precipitation, taught by the starting tabular grain emulsion citations above.

Iodide is introduced as a solute into the reaction vessel containing the starting {111} tabular grain emulsion. Any water soluble iodide salt can be employed for supplying the iodide solute. For example, the iodide can be introduced in the form of an aqueous solution of an ammonium, alkali or alkaline earth iodide.

Instead of providing the iodide solute in the form of an iodide salt, it can instead be provided in the form of an organic iodide compound, as taught by Kikuchi et al EPO 0 561 415. In this instance a compound satisfying the formula:

$$R—I \qquad (I)$$

is employed, wherein R represents a monovalent organic residue which releases iodide ion upon reacting with a base or a nucleophilic reagent acting as an iodide releasing agent. When this approach is employed iodide compound (I) is introduced followed by introduction of the iodide releasing agent.

As a further improvement R—I can be selected from among the methionine alkylating agents taught by King et al U.S. Pat. No. 4,942,120, the disclosure of which is here incorporated by reference. These compounds include α-iodocarboxylic acids (e.g., iodoacetic acid), α-iodoamides (e.g., iodoacetamide), iodoalkanes (e.g., iodomethane) and iodoalkenes (e.g., allyl iodide).

A common alternative method in the art for introducing iodide during silver halide precipitation is to introduce iodide ion in the form of a silver iodide Lippmann emulsion. The introduction of iodide in the form of a silver salt does not satisfy the requirements of the invention.

In the preparation of the tabular grain emulsions of the invention iodide ion is introduced without concurrently introducing silver. This creates conditions within the emulsion that drive iodide ions into the face centered cubic crystal lattice of the tabular grains. The driving force for iodide introduction into the tabular grain crystal lattice structure can be appreciated by considering the following equilibrium relationship:

$$Ag^+ + X^- \leftrightharpoons AgX \qquad (II)$$

where X represents halide. From relationship (II) it is apparent that most of the silver and halide ions at equilibrium are in an insoluble form while the concentration of soluble silver ions ($Ag^+$) and halide ions ($X^-$) is limited. However, it is important to observe the equilibrium is a dynamic equilibrium—that is, a specific iodide is not fixed in either the right hand or left hand position in relationship (II). Rather, a constant interchange of iodide ion between the left and right hand positions is occurring.

At any given temperature the activity product of $Ag^+$ and $X^-$ is at equilibrium a constant and satisfies the relationship:

$$Ksp=[Ag^+][X^-] \quad (III)$$

where Ksp is the solubility product constant of the silver halide. To avoid working with small fractions the following relationship is also widely employed:

$$-\log Ksp=pAg+pX \quad (IV)$$

where pAg represents the negative logarithm of the equilibrium silver ion activity and pX represents the negative logarithm of the equilibrium halide ion activity.

From relationship (IV) it is apparent that the larger the value of the –log Ksp for a given halide, the lower is its solubility. The relative solubilities of the photographic halides (Cl, Br and I) can be appreciated by reference to Table I:

TABLE I

| Temp. °C. | AgCl –log Ksp | AgI –log Ksp | AgBr –log Ksp |
|---|---|---|---|
| 40 | 9.2 | 15.2 | 11.6 |
| 50 | 8.9 | 14.6 | 11.2 |
| 60 | 8.6 | 14.1 | 10.8 |
| 80 | 8.1 | 13.2 | 10.1 |

From Table I it is apparent that at 40° C. the solubility of AgCl is one million times higher than that of silver iodide, while, within the temperature range reported in Table I the solubility of AgBr ranges from about one thousand to ten thousand times that of AgI. Thus, when iodide ion is introduced into the starting tabular grain emulsion without concurrent introduction of silver ion, there are strong equilibrium forces at work driving the iodide ion into the crystal lattice structure in displacement of the more soluble halide ions already present.

The benefits of the invention are not realized if all of the more soluble halide ions in the crystal lattice structure of the starting tabular grains are replaced by iodide. This would destroy the face centered cubic crystal lattice structure, since iodide can only be accommodated in a lattice structure to a limited degree, and the net effect would be to destroy the tabular configuration of the grains. Thus, it is specifically contemplated to limit the iodide ion introduced to 10 mole percent or less, preferably 5 mole percent or less, of the total silver forming the starting {111} tabular grain emulsion. A minimum iodide introduction of at least 0.5 mole percent, preferably at least 1.0 mole percent, based on starting silver, is contemplated.

When the iodide ion is run into the starting tabular grain emulsion at rates comparable to those employed in conventional double-jet run salt additions, the iodide ion that enters the {111} tabular grains by halide displacement is not uniformly or randomly distributed. Clearly the surface of the {111} tabular grains are more accessible for halide displacement. Further, on the surfaces of the {111} tabular grains, halide displacement by iodide occurs in a preferential order. Assuming a uniform surface halide composition in the starting {111} tabular grains, the crystal lattice structure at the corners of the tabular grains is most susceptible to halide ion displacement, followed by the edges of the {111} tabular grains. The major faces of the {111} tabular grains are least susceptible to halide ion displacement. It is believed that, at the conclusion of the iodide ion introduction step (including any necessary introduction of iodide releasing agent), the highest iodide concentrations in the {111} tabular grains occur in that portion of the crystal lattice structure forming the corners of the {111} tabular grains.

The next step of the process of preparation is to remove iodide ion selectively from the corners of the {111} tabular grains. This is accomplished by introducing silver as a solute. That is, the silver is introduced in a soluble form, analogous to that described above for iodide introduction. In a preferred form the silver solute is introduced in the form of an aqueous solution similarly as in conventional single-jet or double-jet precipitations. For example, the silver is preferably introduced as an aqueous silver nitrate solution. No additional iodide ion is introduced during silver introduction.

The amount of silver introduced is in excess of the iodide introduced into the starting tabular grain emulsion during the iodide introduction step. The amount of silver introduced is preferably on a molar basis from 2 to 20 (most preferably 2 to 10) times the iodide introduced in the iodide introduction step.

When silver ion is introduced into the high corner iodide {111} tabular grain emulsion, halide ion is present in the dispersing medium available to react with the silver ion. One source of the halide ion comes from relationship (II). The primary source of halide ion, however, is attributable to the fact that photographic emulsions are prepared and maintained in the presence of a stoichiometric excess of halide ion to avoid the inadvertent reduction of $Ag^+$ to $Ag^\circ$, thereby avoiding elevating minimum optical densities observed following photographic processing.

As the introduced silver ion is precipitated, it removes iodide ion from the dispersing medium. To restore the equilibrium relationship with iodide ion in solution the silver iodide at the corners of the grains (see relationship II above) exports iodide ion from the corners of the grains into solution, where it then reacts with additionally added silver ion. Silver and iodide ion as well as chloride and/or bromide ion, which was present to provide a halide ion stoichiometric excess, are then redeposited.

To direct deposition to the edges of the {111} tabular grains and thereby avoid thickening the {111} tabular grains as well as to avoid silver ion reduction, the stoichiometric excess of halide ion is maintained and the concentration of the halide ion in the dispersing medium is maintained in those ranges known to be favorable for {111} tabular grain growth. For example, for high (>50 mole percent) bromide emulsions the pBr of the dispersing medium is maintained at a level of at least 1.0. For high (>50 mole percent) chloride emulsions the molar concentration of chloride ion in the dispersing medium is maintained above 0.5M. Depending upon the amount of silver introduced and the initial halide ion excess in the dispersing medium, it may be necessary to add additional bromide and/or chloride ion while silver ion is being introduced. However, the much lower solubility of silver iodide as compared to silver bromide and/or chloride, results in the silver and iodide ion interactions described above being unaffected by any introductions of bromide and/or chloride ion.

The net result of silver ion introduction as described above is that silver ion is deposited at the edges of the {111} tabular grains. Concurrently, iodide ion migrates from the corners of the {111} tabular grains to their edges. As iodide ion is displaced from the tabular grain corners, irregularities are created in the corners of the {111} tabular grains that increase their latent image forming efficiency. It is preferred that the {111} tabular grains exhibit a corner surface iodide concentration that is at least 0.5 mole percent, preferably at least 1.0 mole percent, lower than the highest surface iodide concentration found in the grain—i.e., at the edge of the grain.

Apart from the features described above the {111} tabular grain emulsions of the invention can take any convenient conventional form. If the starting tabular grain emulsion contains no iodide, a minimum amount of iodide is introduced during the iodide introduction step, and a maximum amount of silver is introduced during the subsequent silver ion introduction step, the minimum level of iodide in the resulting emulsion can be as low as 0.4 mole percent. With higher levels of iodide introduction, lower levels of subsequent silver ion introduction, and/or iodide initially present in the starting {111} tabular grains, higher levels of iodide can be present in the {111} tabular grain emulsions of the invention. To accomodate the rapid processing cycles customarily employed in using radiographic elements applied to medical diagnostic applications, preferred emulsions according to the invention contain overall iodide levels of less than 5 mole percent, most preferably, less than 3 mole percent, based on total silver.

In the preferred emulsions according to the invention the {111} tabular grains account for greater than 50 percent of total grain projected area. The {111} tabular grains most preferably account for at least 70 percent, optimally at least 90 percent, of total grain projected area. Any proportion of {111} tabular grains satisfying the iodide profile requirements noted above can be present that is capable of observably enhancing photographic sensitivity. When all of the {111} tabular grains are derived from the same emulsion precipitation, at least 25 percent of the {111} tabular grains exhibit the iodide profiles described above. Preferably {111} tabular grains accounting for at least 50 percent of total grain projected area exhibit the iodide profiles required by the invention.

Preferred emulsions according to the invention are those which are relatively monodisperse. In quantitative terms it is preferred that the coefficient of variation (COV) of the equivalent circular diameters. (ECD's), based on the total grain population of the emulsion as precipitated be less than about 30 percent, preferably less than 20 percent. The COV of ECD is also referred to as $COV_{ECD}$. By employing a highly monodisperse starting {111} tabular grain emulsion, such as an emulsion having a $COV_{ECD}$ of less than 10 percent (disclosed, for example, by Tsaur et al U.S. Pat. No. 5,210,013, the disclosure of which is here incorporated by reference), it is possible to prepare emulsions according to the invention in which $COV_{ECD}$ of the final emulsion is also less than 10. The silver bromide and iodobromide tabular grain emulsions of Tsaur et al U.S. Pat. Nos. 5,147,771, '772, '773, and 5,171,659 represent a preferred class of starting {111} tabular grain emulsions. Sutton et al U.S. Pat. No. 5,334,469 discloses improvements on these emulsions in which the COV of {111} tabular grain thickness, $COV_t$, is less than 15 percent.

The average {111} tabular grain thicknesses (t), ECD's, aspect ratios (ECD/t) and tabularities ($ECD/t^2$, where ECD and t are measured in micrometers, μm) of the emulsions of the invention can be selected within any convenient conventional range. The tabular grains preferably exhibit an average thickness of less than 0.3 μm. Although ultrathin (<0.07 μm mean thickness) {111} tabular grain emulsions can be prepared by the process of the invention, it is preferred that the {111} tabular grain emulsions exhibit an average {111} tabular grain thickness of at least 0.1 μm to obtain silver images that exhibit desirably cold image tones.

Radiographically useful emulsions can have average ECD's of up to 10 μm, but in practice they rarely have average ECD's of greater than 6 μm. Following from the defintion of tabular grains, the average aspect ratio of the tabular grain emulsions is at least 2. Preferably the average aspect ratio of the {111} tabular grain emulsions is greater than 5 and most preferably greater than 8. Maximum average aspect ratios are limited only by selections of tabular grain thicknesses and ECD's within the ranges noted above. Typically, average aspect ratios of tabular grain emulsions in the radiographic elements range up to about 50.

During their preparation, either during preparation of the starting {111} tabular grain emulsions or during iodide and/or silver addition, the tabular grain emulsions of the invention can be modified by the inclusion of one or more dopants, illustrated by *Research Disclosure*, Vol. 365, September 1994, Item 36544, I. Emulsion grains and their preparation, D. Grain modifying conditions and adjustments, paragraphs (3), (4) and (5). *Research Disclosure* is published by Kenneth Mason Publications, Ltd., Dudley House, 12 North St., Emsworth, Hampshire P010 7DQ, England Among conventional emulsion preparation techniques specifically contemplated to be compatible with the present invention are those disclosed in *Research Disclosure*, Item 36544, I. Emulsion grains and their preparation, A. Grain halide composition, paragraph (5); C. Precipitation procedures; and D. Grain modifying conditions and adjustments, paragraphs (1) and (6).

Apart from the incorporation in an amount sufficient to improve speed-granularity relationships of {111} tabular grains having edge and corner iodide placements as described above the {111} tabular grain emulsions and the radiographic elements in which they are employed can take any convenient conventional form.

For example, in addition to forming the sole emulsion coated on opposite sides of the film support, the novel {111} tabular grains described above can be blended with conventional emulsions employed in radiographic elements or coated in separate emulsion layers in the emulsion layer units on opposite sides of the support. Specific illustrations are provided in *Research Disclosure*, Item 36544, I. Emulsion grains and their preparation, E. Blends, layers and performance categories, (6) and (7). Blends of monodispersed and polydispersed tabular grain emulsions are specifically contemplated. In asymmetrical radiographic element constructions the novel tabular grains described above can be present in an emulsion layer unit on only one side of the support.

Chemical sensitization of the {111} tabular grain emulsions is contemplated. A general disclosure of conventional chemical sensitizations is contained in *Research Disclosure*, Item 36544, IV. Chemical sensitization.

It is possible to rely on the iodide within the {111} tabular grains to capture light emitted by intensifying screens. However, in most instances it is preferred to adsorb a spectral sensitizing dye to the surfaces of the silver halide grains to improve screen emitted light absorption. This increases imaging speed and reduces crossover that would otherwise reduce image sharpness. A wide variety of spectral sensitizing dyes are available for selection, as illustrated by *Research Disclosure*, Item 36544, V. Spectral sensitization and desensitization, A. Sensitizing dyes. Kofron et al U.S. Pat. No. 4,439,520 is particularly noted for its disclosure of blue absorbing spectral sensitizing dyes, here incorporated by reference.

To reduce crossover to even lower levels than can be achieved by the use of spectral sensitizing dyes, it is preferred to employ processing solution decolorizable dyes, either in a layer between each emulsion layer unit and the support or in the emulsion layer unit, to reduce crossover to levels of less than 15 percent. It is, in fact, possible to substantially eliminate crossover through the incorporation of processing solution decolorizable dyes. In a specifically contemplated construction, the silver halide emulsion or emulsions forming each emulsion layer unit is divided into two superimposed layers with the layer located nearest the support containing the processing solution decolorizable dye.

Antifoggants and stabilizers can be located within the emulsion layer units. Conventional antifoggants and stabilizers are illustrated by *Research Disclosure*, Item 36544, VII. Antifoggants and stabilizers.

As commonly constructed radiographic elements contain one or more hydrophilic colloid layers coated above the emulsion layer units. These layers can contain components intended to protect the film from damage in handling. For example, materials such as coating aids, plasticizers, lubricants, antistats and matting agents, commonly present in overcoat layers are illustrated by *Research Disclosure*, Item 36544, IX. Coating and physical property modifying addenda.

The emulsions and other layers coated on the supports forming the radiographic elements are processing solution permeable and typically contain a hydrophilic colloid as a vehicle. Conventional vehicle and vehicle modifiers are contemplated in the radiographic elements of the invention. Such materials are illustrated by *Research Disclosure*, Item 36544, II. Vehicles, vehicle extenders, vehicle-like addenda and vehicle related addenda. To facilitate processing in less than 90 seconds (which includes the time required to dry the radiographic element following development and fixing), it is preferred to limit the coating coverage of hydrophilic colloid per side in constructing the radiographic element to less than 65 mg/dm$^2$. To facilitate processing in less than 45 seconds, it is specifically contemplated to limit hydrophilic colloid coverages per side to less than 35 mg/dm$^2$.

Transparent film supports, such as any of those disclosed in *Research Disclosure*, Item 36544, Section XV, are contemplated. The transparent film support typically includes subbing layers to facilitate adhesion of hydrophilic colloids, as illustrated by Section XV, paragraph (2). Although the types of transparent film supports set out in Section XV, paragraphs (4), (7) and (9) are contemplated, the transparent film supports preferred, due to their superior dimensional stability, are polyester film supports, as illustrated by Section XV, paragraph (8). Poly(ethylene terephthalate) and poly(ethylene naphthenate) are specifically preferred polyester film supports. The support is typically blue tinted to aid in the examination of image patterns. Blue anthracene dyes are typically employed for this purpose. For further details of support construction, including exemplary incorporated anthracene dyes and subbing layers, attention is directed to *Research Disclosure*, Vol. 184, August 1979, Item 18431, Section XII. Film Supports.

The following are cited to show conventional radiographic element, exposure and processing features:

| | |
|---|---|
| Dickerson | U.S. Pat. No. 4,414,304; |
| Abbott et al | U.S. Pat. No. 4,425,425; |
| Abbott et al | U.S. Pat. No. 4,425,426; |
| Dickerson | U.S. Pat. No. 4,520,098; |
| Dickerson | U.S. Pat. No. 4,639,411; |
| Kelly et al | U.S. Pat. No. 4,803,150; |

-continued

| | |
|---|---|
| Kelly et al | U.S. Pat. No. 4,900,652; |
| Dickerson et al | U.S. Pat. No. 4,994,355; |
| Dickerson et al | U.S. Pat. No. 4,997,750; |
| Bunch et al | U.S. Pat. No. 5,021,327; |
| Childers et al | U.S. Pat. No. 5,041,364; |
| Dickerson et al | U.S. Pat. No. 5,108,881; |
| Tsaur et al | U.S. Pat. No. 5,252,442; |
| Dickerson | U.S. Pat. No. 5,252,443; |
| Steklenski et al | U.S. Pat. No. 5,259,016; |
| Hershey et al | U.S. Pat. No. 5,292,631; |
| Dickerson | U.S. Pat. No. 5,391,469; |
| Zietlow | U.S. Pat. No. 5,370,977. |

EXAMPLES

The invention can be better appreciated by reference to the following specific embodiments.

Example 1

Emulsion 1C

(a Comparative Emulsion)

In a 4-liter reaction vessel was placed an aqueous gelatin solution (composed of 1 liter of water, 0.56 g of alkali-processed low methionine gelatin, 3.5 ml of 4N nitric acid solution, 1.12 g of sodium bromide and having a pAg of 9.38 and 14.4 wt %, based on total silver used in nucleation, of PLURONIC-31R1™ (a surfactant satisfying the formula:

$$HO-(\overset{\overset{CH_3}{|}}{C}HCH_2O)_y-(CH_2CH_2O)_x-(\overset{\overset{CH_3}{|}}{C}HCH_2O)_{y'}-H \quad (V)$$

where x=7, y=25 and y'=25) while keeping the temperature thereof at 45° C., 11.13 mL of an aqueous solution of silver nitrate (containing 0.48 g of silver nitrate) and 11.13 mL of an aqueous solution of sodium bromide (containing 0.29 g of sodium bromide) were simultaneously added thereto over a period of 1 minute at a constant rate. The mixture was held and stirred for 1 minute during which 14 mL of an aqueous sodium bromide solution (containing 1.44 g of sodium bromide) were added at the 50 second point of the hold. Thereafter, after the 1 minute hold, the temperature of the mixture was raised to 60° C. over a period of 9 minutes. Then 16.7 mL of an aqueous solution of ammonium sulfate (containing 1.68 g of ammonium sulfate) were added and the pH of the mixture was adjusted to 9.5 with aqueous sodium hydroxide (1N). The mixture thus prepared was stirred for 9 minutes. Then 83 mL of an aqueous gelatin solution (containing 16.7 g of alkali-processed gelatin) was added, and the mixture was stirred for 1 minute, followed by a pH adjustment to 5.85 using aqueous nitric acid (1N). The mixture was stirred for 1 minute. Afterward, 30 mL of aqueous silver nitrate (containing 1.27 g of silver nitrate) and 32 mL of aqueous sodium bromide (containing 0.66 g of sodium bromide) were added simultaneously over a 15 minute period. Then 49 mL of aqueous silver nitrate (containing 13.3 g of silver nitrate) and 48.2 mL of aqueous sodium bromide (containing 8.68 g of sodium bromide) were added simultaneously at linearly accelerated rates starting from respective rates of 0.67 mL/min and 0.72 mL/min for the subsequent 24.5 minutes. Then 468 mL of aqueous silver nitrate (containing 191 g of silver nitrate) and 464 mL of aqueous sodium bromide (containing 119.4 g of sodium bromide) were added simultaneously at linear accelerated rates starting from respective rates of 1.67 mL/min and 1.70 mL/min for the subsequent 82.4 minutes. A 1 minute hold while stirring followed.

Then 80 mL of an aqueous silver nitrate solution (containing 32.6 g of silver nitrate) and 69.6 mL of an aqueous halide solution (containing 13.2 g of sodium bromide and 10.4 g of potassium iodide) were added simultaneously over a 9.6 minute period at constant rates. Then 141 mL of an aqueous silver nitrate solution (containing 57.5 g of silver nitrate) and 147.6 mL of aqueous sodium bromide (containing 38.0 g of sodium bromide) were added simultaneously over a 16.9 minute period at constant rates. The silver iodobromide emulsion thus obtained contained 3.6 mole percent iodide. The emulsion was then washed. The properties of grains of this emulsion are shown in Table II.

Emulsion 2E (an Example Emulsion)

The procedure used to prepare Emulsion 1 was employed up to the step at which iodide was introduced. From that point the precipitation proceeded as follows:

Then 16.6 mL of an aqueous potassium iodide solution (containing 10.45 g of potassium iodide) were added over a three minute period at constant flow rate. The solution was delivered to a position in the kettle such that mixing was maximized. After a 10 minute hold, 220.8 mL of an aqueous silver nitrate solution (containing 90.1 g of silver nitrate) were added over a 26.5 minute period at constant flow rate. Then 6.5 minutes after the start of the silver nitrate addition 164.2 mL of aqueous sodium bromide (containing 42.2 g of sodium bromide) were added over a 20.0 minute period at a constant rate. The silver halide emulsion thus obtained contained 3.6 mole percent iodide. The emulsion was then washed. The properties of grains of this emulsion are shown in Table II.

TABLE II

| | Comparison of the Grain Properties | | | | |
|---|---|---|---|---|---|
| | Average Grain Size (μm) | Thickness (μm) | Aspect Ratio | Average Tabularity | $COV_{ECD}$ |
| Emulsion 1 | 2.37 | 0.11 | 22 | 196 | 9.8 |
| Emulsion 2 | 2.31 | 0.12 | 19 | 160 | 9.3 |

Performance Comparison

The emulsions listed in Table II were optimally sulfur and gold sensitized and minus blue sensitized with a combination of anhydro-5-chloro-9 -ethyl-5'-phenyl-3'-(3-sulfobutyl)-3-(3-sulfopropyl)-oxacarbocyanine hydroxide, sodium salt (SS-1) and anhydro-3,9-diethyl-3'-[N-(methylsulfonyl-)carbamoylmethyl]-5-phenylbenzothiazolooxacarbocyanine hydroxide, inner salt (SS-2) in an 8.2:1 ratio by weight, as the sensitizing dyes present in the finish. Single layer coatings on a transparent film support employed cyan dye-forming coupler (CC-1) at a coating coverage of 1.6 mg/dm$^2$ and a silver coating coverage of 8.1 mg/dm$^2$.

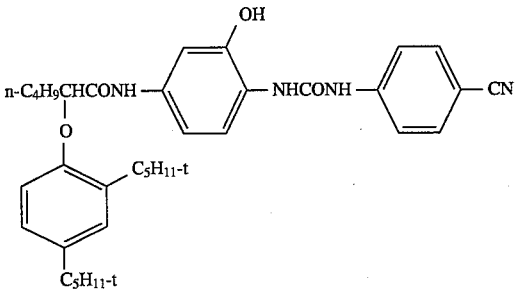

A sample of each coating was exposed by a tungsten light source through a graduated density test object and a Wratten 9™ filter, which permits significant transmission at wavelengths longer than 480 nm. Processing was conducted using the Eastman Flexicolor™ color negative processing chemicals and procedures.

Sensitometric speed comparisons are provided in Table III. Speed was measured at an optical density of 0.15 above minimum density. Emulsion 1C was assigned a relative speed of 100, and each unit of difference in reported relative speeds is equal to 0.01 log E, where represents exposure in lux-seconds.

TABLE III

| Speed Comparisons | |
|---|---|
| Emulsion | Relative Speed |
| 1C (comparative) | 100 |
| 2E (invention) | 111 |

To provide a frame of reference, in photography a relative speed increase of 30 (0.30 log E) allows one full stop reduction in exposure. Thus, it is apparent that the emulsion of the invention would allow a photographer a one half stop reduction in exposure.

Morphology Comparison

Grains from both Emulsions 1C and 2E were examined microscopically and observed to contain different tabular grain structures.

The iodide concentrations of a representative sample of the tabular grains were examined at different points across their major faces, either from edge-to-edge or corner-to-corner (see lines E—E and C—C, respectively, in the Brief Description of the Drawings above). Analytical electron microscopy (AEM) was employed. A major face of each tabular grain examined was addressed at a succession of points, and the average iodide concentration through the entire thickness of the tabular grain at each point addressed was read and plotted.

In FIG. 2 an edge-to-edge plot E2 and a corner-to-corner plot C2 are shown for a representative tabular grain taken from Emulsion 1C. Notice that in both plots the highest iodide concentration is found at the periphery of the tabular grain. There is no significant difference between the iodide concentration at a corner of the grain and at a peripheral location between the corners. All of the tabular grains examined from Emulsion 1C exhibited these edge and corner iodide profile characteristics.

A total of 60 tabular grains were examined from Emulsion 2E were examined. Of these 17 exhibited edge-to-edge and corner-to-corner iodide profiles similar to the tabular grains of Emulsion 1C. However, 43 of the tabular grains exhibited unique and surprising iodide profiles. An edge-to-edge iodide profile E1 and a corner-to-corner iodide profile C1 is shown in FIG. 1 for a tabular grain representative of the 43 tabular grains having unique structures. Notice that the highest iodide concentration is observed at the tabular grain peripheral edges of the edge-to-edge plot E1. On the other hand, the corner-to-corner plot C1 shows no significant variation in iodide content at the tabular grain periphery. Clearly the highest iodide concentrations in these unique tabular grains are located at the edges of the tabular grains, but the iodide content within the corners of the tabular grains are clearly significantly lower than that observed elsewhere along the tabular grain peripheral edges.

Example 2

The following description is based on 1 liter initial volume.

Emulsion 3C (AgBr Tabular Grain Comparative Emulsion)

Into a reaction vessel with good mixing were placed an aqueous gelatin solution (composed of 1 liter of water, 1.5 g of oxidized alkali-processed gelatin, 3 mL of 4N nitric acid, 0.6267 g of sodium bromide, and 9.4%, based on the total weight of silver introduced during nucleation, of PLURONIC-31R1™, a surfactant satisfying formula II, x=25, x'=25, y=7 described in U.S. Pat. No. 5,147,771), and, while keeping the temperature thereof at 45° C., 3.1 mL of an aqueous solution of silver nitrate (containing 1.37 g of silver nitrate) and equal amount of an aqueous halide solution (containing 0.83 g of sodium bromide and 0.034 g of potassium iodide) were simultaneously added into the vessel over a period of 1 minute to achieve nucleation at a constant rate. After a hold of 1 minute, 19.2 mL of an aqueous halide solution (containing 1.97 g of sodium bromide) were added into the vessel. The temperature of the vessel was immediately raised to 60° C. over a period of 9 minutes. At that time, 36.5 mL of an ammoniacal solution (containing 2.53 g of ammonium sulfate and 21.8 mL of 2.5N sodium hydroxide solution) were added to the vessel, and mixing was conducted for a period of 9 minutes. Then, 250 mL of an aqueous gelatin solution (containing 16.7 g of oxidized alkali-processed gelatin, 5.7 mL of 4N nitric acid solution, and 0.07 g of PLURONIC-31R1™) was added to the mixture over a period of 4 minutes. This was followed by a growth segment, which started with the introduction of 15 mL of an aqueous silver nitrate solution (containing 6.62 g of silver nitrate) and 15.7 mL of an aqueous halide solution (containing 4.32 g of sodium bromide) at a constant rate over a period of 10 minutes. Thereafter, 487.5 mL of an aqueous silver nitrate solution (containing 215.3 g of silver nitrate) and 485 mL of an aqueous halide solution (containing 133.7 g of sodium bromide) were added at a constant ramp over a period of 75 minutes starting from 1.5 mL/min and 1.53 mL/min, respectively. Subsequently, 232.8 mL of an aqueous silver nitrate solution (containing 102.8 g of silver nitrate) and 230.4 mL of an aqueous halide solution (containing 63.5 g of sodium bromide) were added into the vessel at a constant rate over a period of 20.24 minutes.

The resulting silver bromide tabular grain emulsion exhibited the grain properties summarized in Table IV.

Emulsion 4C (a Comparative Uniform Iodide $AgBr_{98\%}I_{2\%}$ Tabular Grain Emulsion)

In a reaction vessel with good mixing were placed an aqueous gelatin solution (composed of 1 liter of water, 2 g of oxidized alkali-processed gelatin, 3.83 mL of 4N nitric acid, 0.6267 g of sodium bromide, and 0.91%, based on the total weight of silver introduced during nucleation, of PLURONIC-L43™, a surfactant satisfying formula II, x=22, y=6, y'=6 described in U.S. Pat. No. 5,147,659), and, while keeping the temperature thereof at 45° C., 13.3 mL of an aqueous solution of silver nitrate (containing 2.94 g of silver nitrate) and equal amount of an aqueous halide solution (containing 1.84 g of sodium bromide) were simultaneously added to the vessel over a period of 1 minute to achieve nucleation at a constant rate. After a hold of 1 minute, 19.2 mL of an aqueous halide solution (containing 1.97 g of sodium bromide) was added into the vessel. The temperature of the vessel was immediately raised to 60° C. over a period of 9 minutes. At that time, 44.3 mL of an ammoniacal solution (containing 3.37 g of ammonium sulfate and 26.7 mL of 2.5N sodium hydroxide solution) was added into the vessel and mixing was conducted for a period of 9 minutes. Then, 177 mL of an aqueous gelatin solution (containing 16.7 g of oxidized alkali-processed gelatin, and 10 mL of 4N nitric acid solution) were added to the mixture over a period of 2 minutes. This was followed by a growth segment, which started with the introduction of 7.5 mL of an aqueous silver nitrate solution (containing 1.66 g of silver nitrate) and 7.7 mL of an aqueous halide solution (containing 1.03 g of sodium bromide) at a constant rate over a period of 5 minutes. Thereafter, 474.7 mL of an aqueous silver nitrate solution (containing 129.0. g of silver nitrate) and 462.4 mL of an aqueous halide solution (containing 79.1 g of sodium bromide and 2.56 g of potassium iodide) were added at a constant ramp over a period of 64 minutes starting from 1.5 mL/min and 1.58 mL/min, respectively. Subsequently, 253.3 mL of an aqueous silver nitrate solution (containing 68.9 g of silver nitrate) and 246.4 mL of an aqueous halide solution (containing 42.1 g of sodium bromide and 1.37 g of potassium iodide) were added into the vessel at constant rate over a period of 19 minutes.

The resulting uniform iodide silver iodobromide tabular grain emulsion exhibited the grain properties summarized in Table IV.

Emulsion 5E (an Example $AgBr_{98\%}I_{2\%}$ Tabular Grain Emulsion)

Into a reaction vessel with good mixing were placed an aqueous gelatin solution (composed of 1 liter of water, 2.0 g of oxidized alkali-processed gelatin, 3.5 mL of 4N nitric acid, 0.6267 g of sodium bromide, and 5.4%, based on the total weight of silver introduced during nucleation, of PLURONIC-31R1™, a surfactant satisfying formula II, x=25, x'=25, y=7 described in U.S. Pat. No. 5,147,771), and, while keeping the temperature thereof at 45° C., 10.8 mL of an aqueous solution of silver nitrate (containing 2.94 g of silver nitrate) and equal amount of an aqueous halide solution (containing 1.83 g of sodium bromide) were simultaneously added into the vessel over a period of 1 minute of nucleation at a constant rate. After a hold of 1 minute, 19.2 mL of an aqueous halide solution (containing 1.97 g of sodium bromide) were added into the vessel. Temperature of the vessel was immediately raised to 60° C. over a period of 9 minutes. At that time, 41.3 mL of an ammoniacal solution (containing 2.53 g of ammonium sulfate and 24.7 mL of 2.5N sodium hydroxide solution) were added into the vessel, and mixing was conducted for a period of 9 minutes. Then, 176.9 mL of an aqueous gelatin solution (containing 16.7 g of oxidized alkali-processed gelatin, 10.2 mL of 4N nitric acid solution, and 0.11 g of PLURONIC- 31R1™) were added to the mixture over a period of 4 minutes. It was followed by growth segment which started with the introduction of 8.3 mL of an aqueous silver nitrate solution (containing 2.26 g of silver nitrate) and 8.5 mL of an aqueous halide solution (containing 1.43 g of sodium bromide) at a constant rate over a period of 5 minutes. Thereafter, 480 mL of an aqueous silver nitrate solution (containing 130.5 g of silver nitrate) and 488 mL of an aqueous halide solution (containing 136.0 g of sodium bromide) were added at a constant ramp over a period of 64 minutes starting from 1.67 mL/min and 1.78 mL/min, respectively. Subsequently, 26.7 mL of an aqueous silver nitrate solution (containing 7.25 g of silver nitrate) and 26.9 mL of an aqueous halide solution (containing 4.5 g of sodium bromide) were added into the vessel at a constant rate over a period of 2 minutes. Twenty four mL of a potassium iodide solution (containing 3.98 g of potassium iodide) were then added at a constant rate over a period of 46 sec at the same point of mixer as the other halide solutions. The vessel was then held for 10 minutes following the iodide solution addition. Finally, 226.4 mL of an aqueous silver nitrate solution (containing 61.5 g of silver nitrate) at a constant ramp over a period of 53.8 minutes starting from 1.67 mL/min and 173.1 mL of an aqueous halide solution (containing 29.2 g of sodium bromide) were added at a rate to maintain pAg at 7.944 were added to the reaction vessel.

The resulting example silver iodobromide tabular grain emulsion with edge and corner iodide distributed to satisfy the requirements of the invention exhibited the grain properties summarized in Table IV.

TABLE IV

| | Comparison of the Grain Properties | | | | |
|---|---|---|---|---|---|
| | Average Grain Size (μm) | Thickness (μm) | Aspect Ratio | Average Tabularity | $COV_{ECD}$ (%) |
| Emul. 3C | 1.37 | 0.133 | 10 | 77.5 | 12.5 |
| Emul. 4C | 1.14 | 0.131 | 8.7 | 66.4 | 15.4 |
| Emul. 5E | 1.04 | 0.138 | 7.5 | 54.6 | 18.9 |

Performance Comparison

Emulsions 3C, 4C and 5E were optimally sensitized as follows (amounts stated on a per silver mole basis):

At 40° C., the emulsion was added with 4.1 mg potassium tetrachloroaurate, 176 mg sodium thiocyanate, 500 mg green sensitive dye, benzoxazolium, 5-chloro-2 -{2-[5-chloro-3-(3-sulfopropyl)-2[3H]-benzoxazolylidenemethyl]-1-butenyl}-3-(3-sulfopropyl)-N,N-diethylethanamine, 20 mg anhydro-5,6-dimethyl-3(3-sulfopropyl)benzothiozolium, 4.1 mg sodium thiosulfate pentahydrate, and 0.45 mg potassium selenocyanate, heat ramped to 65° C. at 5° C./3 min, held for a time required for optimum sensitization (13 min Emulsion 3C, 16 min Emulsion 4C and 10 min Emulsion 5E), and chilled down to 40° C. Subsequently, 300 mg potassium iodide and 2.2 g 5-methyl-s-triazole-(2-3-a)-pyrimidine-7-ol were added.

21.5 mg Ag/dm$^2$ of each emulsion along with 39.5 mg gelatin/dm$^2$, and 2.5% by weight, based on gelatin, of bis(vinylsulfonyl)methane, a hardener, were coated onto a clear estar film support.

The coatings were subjected through a 21-step tablet to a green exposure (approximating a green intensifying screen emission) for 1/50 sec and then processed at 35° C. in a commercially available Kodak RP X-Omat processor (Model 6B)™ in a rapid access mode in 90 seconds (24 sec development at 35° C., 20 sec fixing at 35° C., 10 sec washing at 35° C., and 20 sec drying at 65° C., the remaining time being taken up in transport between processing steps).

Optical densities are expressed in terms of diffuse density as measured by an X-rite Model 310™ densitometer. The characteristic curve (density vs. log E) was plotted for each coating processed. Speed, reported in relative speed units, was measured at 0.5 above minimum density. The granularities of the coatings were measured at the mid-scale point with equal density. Adjusted speeds were derived on the basis of 30 relative speed units being equivalent to 7 grain units.

The results are summarized below in Table V:

TABLE V

| Emulsion | Iodide M % | Grain Units | Speed | Adjusted Speed |
|---|---|---|---|---|
| 3C | 0 | 4.2 | 175 | 157 |
| 4C | 2 | −1.1 | 157 | 162 |
| 5E | 2 | 0 | 181 | 181 |

From a comparison of Tables IV and V, it is noted that even though Emulsion 5E exhibited the lowest mean ECD, lowest tabular grain thickness, and lowest tabularity, each of which favored a comparatively higher speed for Emulsions 3C and 4C, Emulsion 5E was quite surprizingly the highest speed emulsion, either on the basis of direct speed comparisons or comparisons that adjust speed based on relative granularity. The grain units in Table V are relative grain units. That is, the differences between the grain units of Emulsion 5E are shown.

The invention has been described in detail with particular reference to preferred embodiments thereof, but it will be understood that variations and modifications can be effected within the spirit and scope of the invention.

What is claimed is:

1. A radiographic element for diagnostic imaging comprised of a transparent support and first and second silver halide emulsion layer units coated on opposite sides of the support, each emulsion layer unit being comprised of a silver iodohalide emulsion containing less than 5 mole percent iodide, based on silver, and tabular grains accounting for at least 50 percent of total grain projected area including tabular grains having {111} major faces, containing a maximum surface iodide concentration along their edges, and a lower iodide concentration within their corners than elsewhere along their edges.

2. A radiographic element for medical diagnostic imaging according to claim 1 wherein the tabular grain emulsion contains less than 3 mole percent iodide, based on silver.

3. A radiographic element for medical diagnostic imaging according to claim 1 wherein the tabular grains contain at least 50 mole percent bromide.

4. A radiographic element for medical diagnostic imaging according to claim 3 wherein the silver iodohalide tabular grains are silver iodobromide, silver chlorobromide or silver chloroiodobromide grains.

5. A radiographic element for medical diagnostic imaging according to claim 4 wherein the silver iodohalide tabular grains are silver iodobromide grains.

6. A radiographic element for medical diagnostic imaging according to claim 1 wherein the surface iodide concentration of the tabular grains at a corner is at least 0.5 mole percent less than the maximum edge surface iodide concentration.

7. A radiographic element for medical diagnostic imaging according to claim 6 wherein the surface iodide concentration of the tabular grains at a corner is at least 1.0 mole percent less than the maximum edge surface iodide concentration.

* * * * *